United States Patent [19]

Sato

[11] 3,961,441

[45] June 8, 1976

[54] SONIC RESPONSIVE TOY VEHICLE STEERING SYSTEM

[76] Inventor: Akihiro Sato, No. 9-10 Tateishi 7-chome, Katsushika, Tokyo, Japan

[22] Filed: Mar. 7, 1975

[21] Appl. No.: 556,328

[30] Foreign Application Priority Data

Apr. 4, 1974 Japan ..... 49-38256

[52] U.S. Cl. ..... 46/256; 46/262

[51] Int. Cl.[2] ..... A63H 17/36

[58] Field of Search ..... 46/244 C; 318/266, 300

[56] References Cited

UNITED STATES PATENTS

| | | | |
|---|---|---|---|
| 2,974,441 | 3/1961 | Denner | 46/244 C |
| 3,192,460 | 6/1965 | Wolff et al. | 318/300 |

*Primary Examiner*—Louis G. Mancene
*Assistant Examiner*—Robert F. Cutting

[57] ABSTRACT

The present invention relates to a toy vehicle provided with a chassis, front and rear wheels mounted to the chassis for rotation, a support mounted for movement with respect to the chassis and to which the front wheels are also mounted, a miniature electric motor operatively connected through a first gearing system to the rear wheels for rotating same, a second gearing system normally inoperative but when actuated being driven by the first gearing system to move the support to which the front wheels are connected predetermined directions to turn the front wheels for steering, a handheld sound wave generating unit remote from the vehicle, a sonic transducer within the vehicle for translating the sound waves generated by the handheld unit to electrical signals for energizing through a pulse amplifier, one-shot circuit and power amplifier, an electromagnet within the vehicle which activates the aforementioned second gearing system.

11 Claims, 11 Drawing Figures

SONIC RESPONSIVE TOY VEHICLE STEERING SYSTEM

BACKGROUND AND SUMMARY OF THE INVENTION

The present invention relates to the general class of toys wherein the child is permitted to steer a toy vehicle from a remote position. In particular, the present invention utilizes a constant frequency handheld sound wave generating unit to transmit sonic waves to a transducer within the vehicle which is responsible for translating the sound waves into proportional electrical signals which energize an electromagnet which is responsible for actuating a system which changes the front wheels from a straight ahead direction to a turning direction and vice versa. In this manner, the necessity of electrically connecting the toy vehicle to the remote control station with wiring is eliminated. Moreover, the toy vehicle disclosed herein utilizes a simplified electro-mechanical sonic responsive system for actuating the steering system.

DESCRIPTION OF THE PREFERRED EMBODIMENTS

Figure 1:
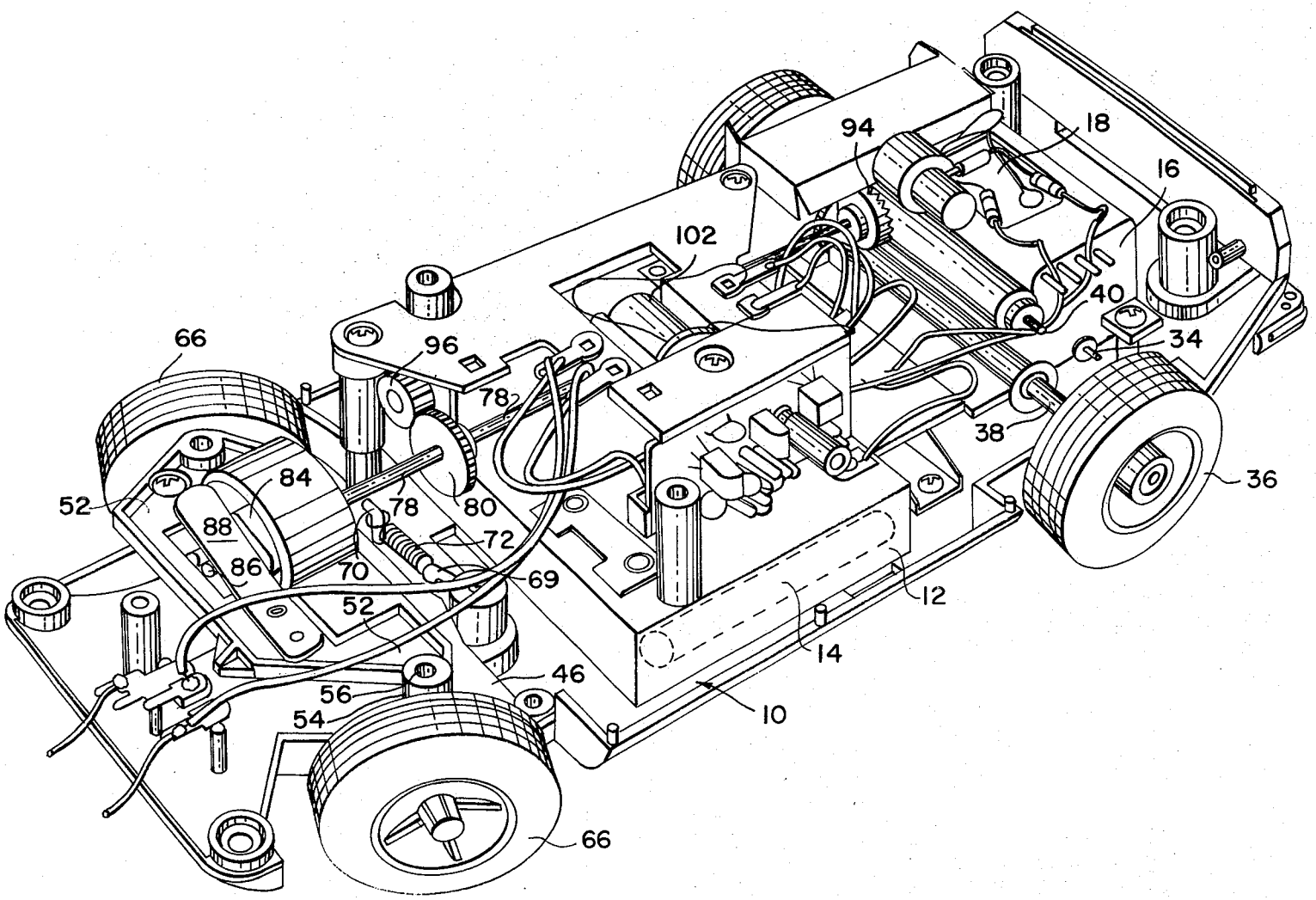
FIG. 1 is a perspective view of the toy vehicle with the casing thereof removed so as to illustrate the arrangement of the working parts.

The toy vehicle, as illustrated in FIG. 1, is provided with a chassis 10 having a compartment 12 within which a plurality of transistor batteries 14 are located. Also mounted to the chassis 10 is a housing 16 within which a miniature electric motor 18 is located. By appropriate electrical circuitry, described hereinafter, the batteries 14 are electrically connected to the motor 18 to energize same causing the shaft 20 to rotate (see FIG. 7).

Figure 2:
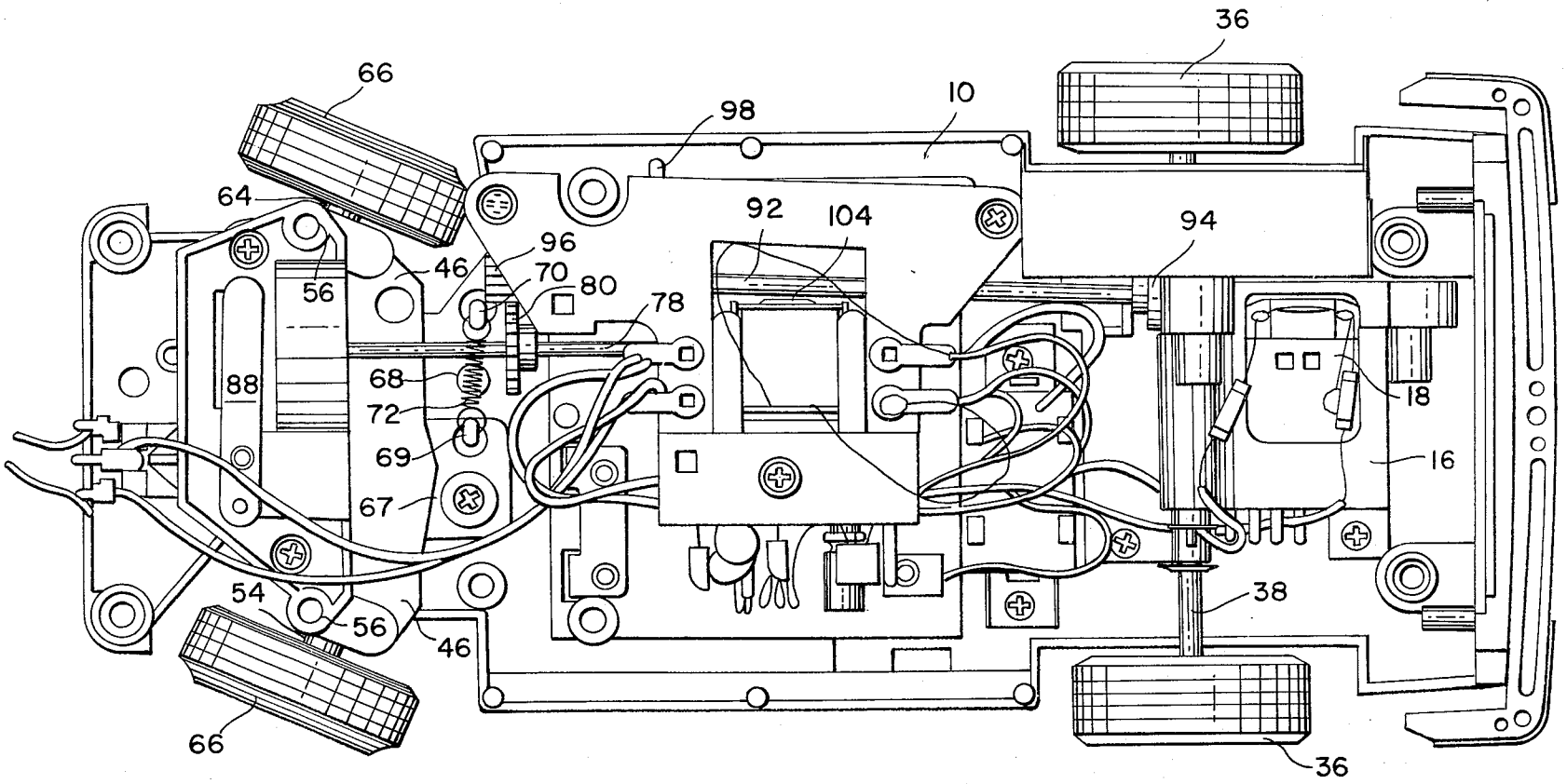
FIG. 2 is a top plan view of the toy vehicle with the casing thereof removed illustrating the arrangement of the gearing systems when the front wheels are turned to the right for steering purposes, and also the relationship between the sonic responsive electromagnet and that portion of the gearing system responsible for performing the steering function.
Figure 7:
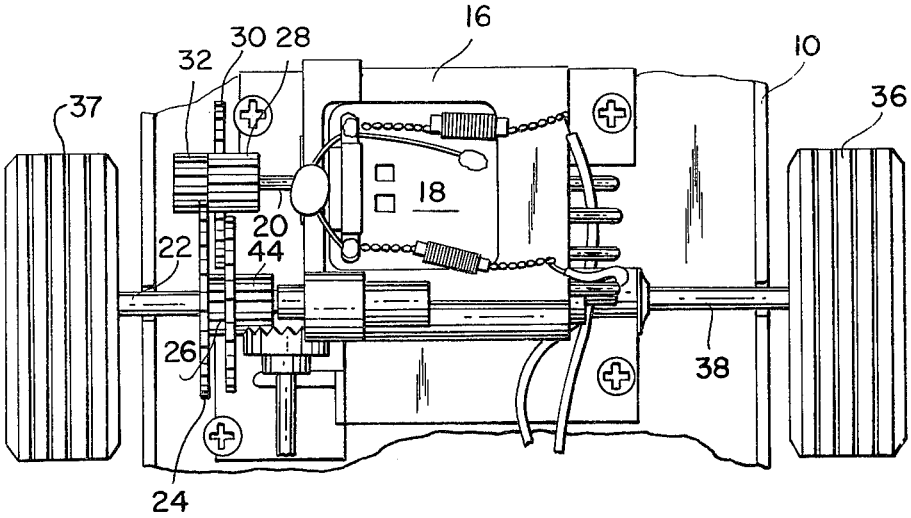
FIG. 7 is a top plan view of a portion of the vehicle illustrating in particular the miniature electric motor, the gearing system responsible for rotating the rear wheels of the vehicle, and a portion of the auxiliary gearing system which when operative is responsible for rotating the front wheels for steering.
Figure 8:
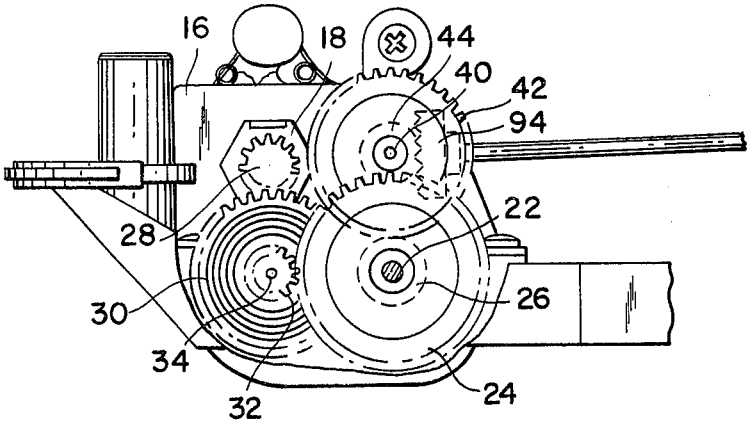
FIG. 8 is a side elevational view of a portion of the vehicle illustrating the gearing system responsible for both rotating the rear wheels as well as transmitting power to the auxiliary gearing system that is responsible for turning the front wheels.

As illustrated in FIGS. 2, 7 and 8, a rear axle 22 is suitably journalled within the chassis 10 and gear wheels 24 and 26 rigidly secured thereto. The shaft 20 of the motor terminates in a pinion wheel 28 which engages a further gear wheel 30 that is mounted with gear wheel 32 to rotate about a shaft 34 which is journalled within the motor housing 16. As the gear wheel 32 meshes with gear wheel 24 it is apparent that as the motor 18 is energized the rotation of the shaft 20 causes the pinion wheel 28 to rotate in turn meshing with and rotating the gears 30 and 32, the rotation of the gear wheel 32 thereby rotating the gear wheel 24 which in turn rotates the rear axle 22 in turn imparting rotation to the rear wheel 36, it being noted from FIG. 7 that the clamp 38 rigidly secures the rear wheel 36 to the rear axle 22, while rear wheel 37 is free to turn on rear axle 22.

It will be further apparent from FIG. 8 that there is a shaft 40 positioned above the rear axle 22 and appropriately journalled within the motor housing 16. Gear wheels 42 and 44 are rigidly mounted to the shaft 40 while the gear wheel 26 which is mounted to the rear axle 22 meshes with and thus rotates the gear wheel 42 to which is connected a smaller gear 44. The operation of the gear wheels 42 and 44 will be explained in detail hereinafter.

Figures 6, 6A, 6B:
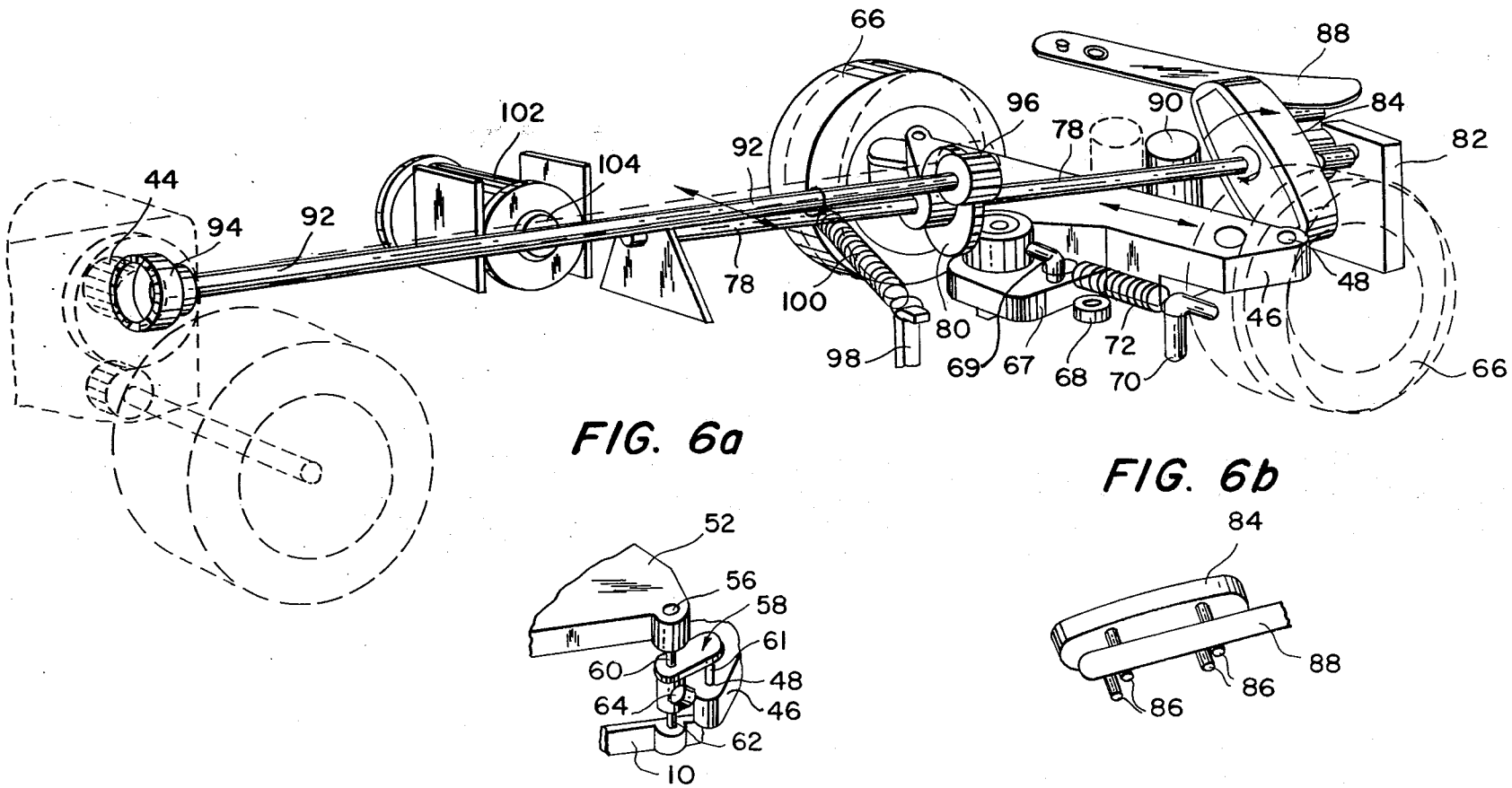
FIG. 6 is a perspective view of that part of the gearing and steering system of the toy vehicle that is responsible for rotating the front wheels in predetermined direction and degree when the electromagnet is energized in response to operation of the handheld sound wave generating unit.
FIG. 6*a* is a perspective view illustrating one of the rods that operably connects the front wheels to both the chassis and the movably mounted support responsible for permitting the front wheels to rotate with respect to the chassis in response to operation of a gearing system that moves the support in response to energization of the electromagnet.
FIG. 6*b* is a perspective view illustrating the relationship between the flat spling and the prongs projecting outwardly from the actuating member whereby the front wheels of the vehicle are rotated between predetermined positions.

Referring now to FIGS. 2 and 6, it is apparent that at the front of the vehicle there is provided a support 46 which is provided with openings 48 at each end thereof. A bracket 52 is suspended above the chassis 10 by legs 54 and at each end thereof there are provided openings 56. As will be apparent from FIG. 6*a*, there is provided on each side of the vehicle a connection rod 58 including a first arm 60 which is disposed within the opening 56 within the bracket 52, a second arm 61 which is disposed within the opening 48 of the support 46, and a third arm 62 that is positioned within a suitable opening provided within the chassis 10. Furthermore, each connecting rod 58 is provided with an axle 64 extending outwardly therefrom to which the front wheel 66 is rotatably mounted. It will therefore be apparent that each of the front wheels 66 is free to pivot about an axis defined by the upper and lower arms 60 and 62 of the rod 58 which, as previously explained, are appropriately journalled within the bracket 52 and the support 46. It will be further apparent that the support 46 is provided with an abutment 67 while the chassis is provided with a similar abutment 68. The spring 72 is attached to the arm 69 extending upwardly from the abutment 67 and the arm 70 extending upwardly from the chassis 10 such that the support 46 to which the wheels 66 are secured is normally urged in a clockwise direction to assume a straight position when the abutments 67 and 68 engage.

Turning now to the mechanism for rotating the front wheels 66, it will be noted from FIGS. 1, 2 and 6 that the shaft 78 has one end thereof appropriately journalled within a portion of the chassis 10 and a gear wheel 80 fixedly secured thereto near the mid portion thereof. The other end of the shaft 78 is journalled within the front portion 82 of the bracket 52. Rigidly secured to the shaft 78 is a generally oblong actuating member 84 as can best be seen in FIG. 6. The front end of member 84 is provided with four outwardly extending cylindrical prongs 86, while a resilient leaf spring 88 is mounted at one end to the top of the bracket 52 such that the other end thereof is generally held in abutting relationship against the prongs 86. It is to be noted that the force of the spring 88 is sufficiently great to force the actuating member 84 and the shaft 78 to rotate to a position such that the flat edge of the spring 88 aligns itself with two of the prongs 86 and retains the member 84 in such position until moved. When the actuating member 84 is in a generally vertical position, the spring 72 is operable to rotate the support 46 and the front wheels 66 attached thereto in a generally counterclockwise direction as illustrated in FIG. 2. When the actuating member 84 is in a generally horizontal position, however, the edge thereof engages the side wall of the upwardly extending abutment 90 which is formed as a part of the support 46 and thus urges the support 46 to the left, as illustrated in FIG. 6, the result of which is to rotate the front wheels 66 in a generally clockwise direction. It is apparent, therefore, that the front wheels 66 may only assume two positions; a first position wherein the wheels 66 are aligned in a forward direction and a second position wherein the wheels 66 are rotated clockwise so as to turn the vehicle to the right.

As illustrated in FIG. 6, there is also provided a shaft 92 terminating at one end thereof in a crown gear 94 and at the other end thereof in a spur gear 96. Note that the chassis 10 is provided with an upstanding abutment 98 to which one end of the spring 100 is secured. The other end of the spring 100 is secured to the shaft 92. In this manner, the spring 100 normally urges the shaft 92 towards the side wall of the chassis 10 such that the spur gear 96 is not in engagement with the gear 80 mounted to the shaft 78. As the crown gear 94 engages the gear 44, previously described, it is apparent that the shaft continuously rotates. Since, however, the spring 100 normally urges the shaft 92 to the side the gears 96 and 80 do not mesh thus preventing the rotation of the shaft 92 from being translated to the shaft 78.

As illustrated in FIGS. 2 and 6, there is mounted within the chassis 10 an electromagnet 102 of conventional construction and suitably wired to the batteries 14 as will be explained hereinafter. At this juncture it is only necessary to point out that the effective face 104 of the electromagnet 102 is spaced from the metal shaft 92 in such a manner that when the electromagnet 102 is energized the metal shaft 92 will be attracted towards the effective face 104 against the force of the spring 100 at which time the spur gear 96 will be moved into engagement with the gear wheel 80 of the shaft 78 at which time the rotary motion of the shaft 92 will be translated to rotary motion of the shaft 78 which in turn rotates the actuating member 84 resulting in the support 46 and the wheels 66 being turned.

Figure 5:
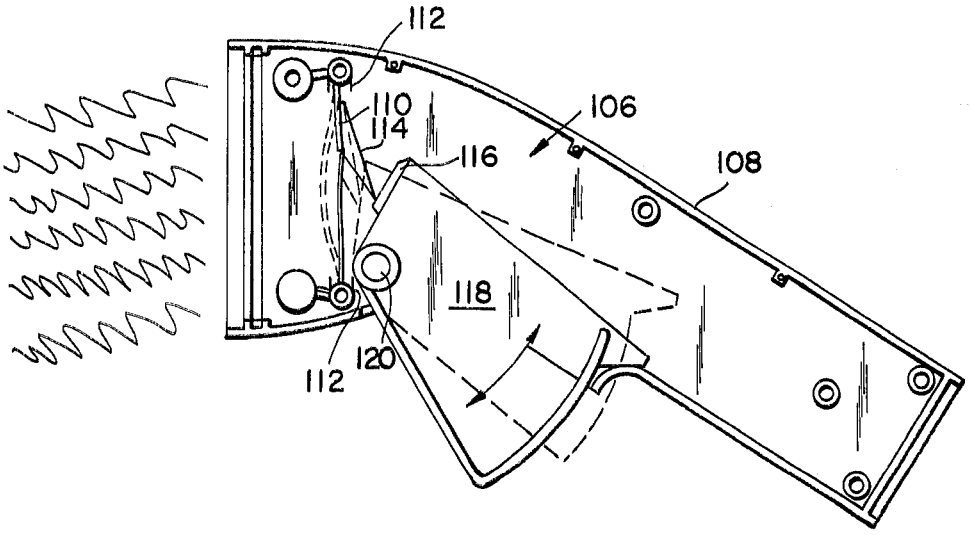
FIG. 5 is a top plan view of the handheld sound wave generating unit with part of the casing thereof removed so as to illustrate operation of the fingerpiece which is responsible for causing a resilient metal plate to produce the desired sound waves.

Turning now to FIG. 5, the reference numeral 106 designates generally a constant frequency hand-held sound wave generating unit comprising a housing 108 within which there is mounted a resilient metal plate 110, the ends of which are secured within the arms 112 of the housing 108. The plate 110 is provided with an outwardly extending actuating member 114 which normally engages the shoulder 116 of a fingerpiece 118 mounted to rotate about the shaft 120 which is suitably journalled within the housing 108. It will be apparent that the engagement of the actuating member 114 against the shoulder 116 of the fingerpiece 18 normally urges the fingerpiece outwardly to its inoperative position. When the fingerpiece 118 is depressed against the force of the actuating member 114 the effect is to move both the actuating member 114 and the sound producing plate 110 inwardly to the position illustrated in dotted lines which eventually produces a sharp "clicking" sound. As will be explained in detail hereinafter, this sound is responsible for actuating the electromagnet 102 which in turn is responsible for rotating the front wheels 66 of the toy vehicle. The general organization and operation of the sonic, electrical and mechanical systems is schematically illustrated in FIG. 3.

Figure 4:
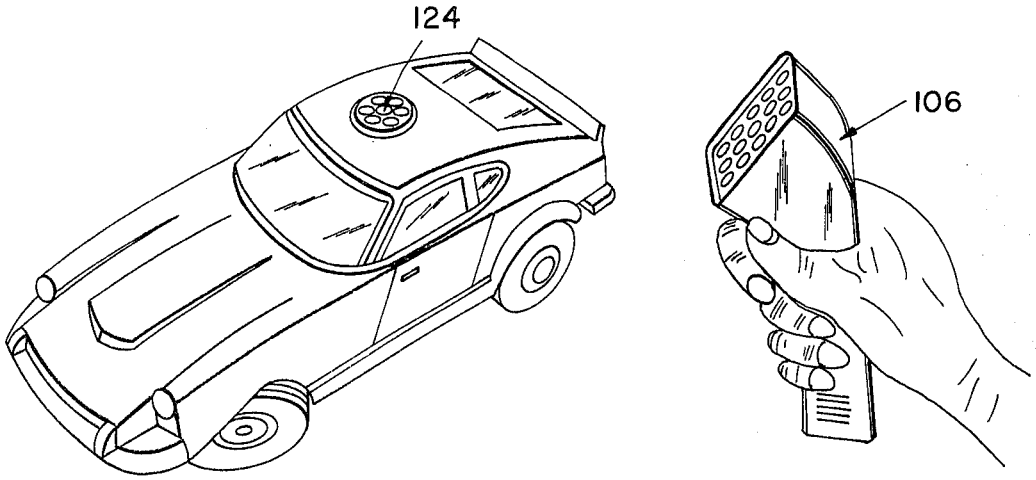
FIG. 4 is a perspective view illustrating the operating relationship between the handheld sound wave generating unit and the toy vehicle which is provided with a sonic transducer mounted in the top roof thereof.

As illustrated in FIG. 4 there is provided within the top of the toy automobile a sonic transducer generally designated with the reference numeral 124, it being apparent that such transducers are well known in the art as disclosed in U.S. Pat. Nos. 3,439,128; 3,654,402; 3,472,972 and 3,749,854 and may comprise, for example, a crystal microphone compatible with the sound wave generating unit 106 capable of translating sound waves into proportional electrical signals. Since such microphone construction is well known in the art it will suffice to note that the microphone may comprise a housing provided with a sound wave admitting aperture and a diaphragm adjacent thereto. A bimorph, secured to the diaphragm, may consist of a pair of oppositely polarized ceramic wafers having electrodes on each of the faces of the wafers and an electrode connecting the inner faces of the wafers.

Figure 3:
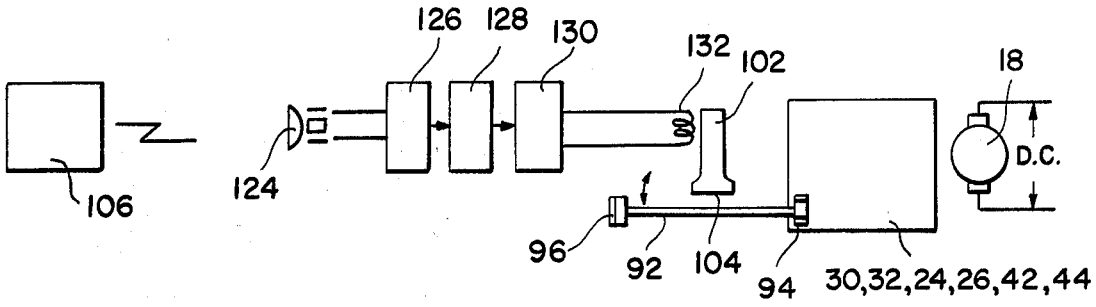
FIG. 3 is a schematic block diagram illustrating the relationship between the handheld sound wave generating unit, the crystal microphone within the toy vehicle, the amplification circuit, the electromagnet for engaging that part of the gearing system responsible for turning the front wheels, and the power plant for operating the gearing system.

FIG. 3 is a basic block diagram of the electrical energizing and timing circuit which provides for the intermittent energization of the electromagnet 102 for driving the steering mechanism through its mechanical linkage as described above. As previously explained, the frequency of the output oscillations of the pulser 106 is selected to be compatible with a sonic/electrical transducer generally illustrated at 124 as a crystal microphone which is frequency selective in response to the received sonic vibrations. The selectivity of course is not critical, it being sufficient that an output pulse from the pulser 106 is effective to produce a recognizable electrical pulse at the output of the transducer 124.

The output signal from transducer 124 is supplied to a pulse amplifier 126 which suitably amplifies the electrical signal from the transducer 124 and provides a pulse of proper wave shape to a one-shot circuit 128. The one-shot circuit 128 then supplies a pulse of a desired duration and amplitude to a power amplifier 130. The power amplifier in turn energizes the winding 132 of the electromagnet 102 for a suitable time duration to actuate the steering mechanism.

Figure 9:
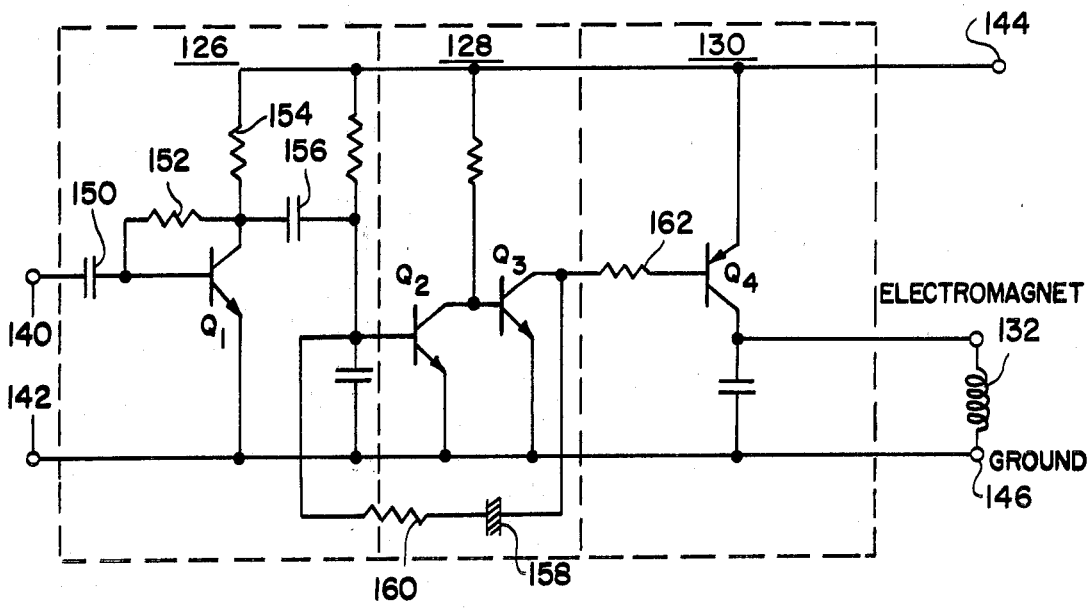
FIG. 9 is an electrical diagram illustrating the circuit for connecting the power source to the electromagnet in response to the transformation of sound waves to electrical signals, including the pulse amplifier, one-shot circuit and power amplifier.

The general block diagram of the energizing circuit shown in FIG. 3 is shown in more detail in FIG. 9 in an illustrative circuit embodiment. The input terminals 140 and 142 correspond to the inputs to the pulse amplifier 126, shown in dotted outline in FIG. 9; the one-shot circuit 128 and the power amplifier 130 are as well shown in dotted outline in FIG. 9. Electromagnet winding 132 also is shown in FIG. 9. Terminals for a suitable DC bias source Vcc 144 and a ground terminal 146 as well are indicated.

The pulse amplifier 126 includes the usual input coupling capacitor 150 and biasing and load resistors 152 and 154 for driving the input transistor Q1 of the pulse amplifier. Coupling capacitor 156 connects the output of transistor Q1 to the base of transistor Q2, the latter having its collector connected to the base of transistor Q3 of the one-shot circuit 128. An RC timing circuit comprising capacitor 158 and resistor 160 couple the output from the collector of transistor Q3 to the base of transistor Q2.

Finally, resistor 162 couples the output of transistor Q3 of the one-shot circuit 128 to the base of transistor Q4 of the power amplifier 130.

Transistor Q1 is normally non-conducting, with the result that the collector terminal thereof is at the positive source potential, rendering the transistor Q2 normally conducting and, in turn, the transistor Q3 normally non-conducting. Transistor Q4 thereby is maintained in a normally non-conductive state. Solenoid winding 132 therefore is normally de-energized.

The electrical signal generated in response to a received sonic pulse from the transducer 124 renders transistor Q1 of the input pulse amplifier 126 conductive, the negative going potential at the collector terminal thereof thereby rendering transistor Q2 non-conductive. The collector of transistor Q2 thereupon is positive-going, turning on transistor Q3. Collector transistor Q3 thereupon becomes clamped to ground potential, rendering Q4 conductive and completing an energizing circuit from the positive power supply terminal 144 (Vcc) through the transistor Q4 and electromagnet winding 132 to ground potential terminal 146 thereby energizing the solenoid winding 132. The RC circuit 158, 160 of the one-shot circuit 128 determines the period of energization of the transistor Q3 in its feedback circuit configuration, thereby turning on transistor Q2 once again and turning off transistor Q3. The collector of transistor Q3, no longer clamped to ground potential, results in transistor Q4 being turned off thereby terminating energization of the solenoid winding 132.

With reference to the above description of the mechanics of the steering mechanism, it will be appreciated that various alternatives may be employed as to the time duration set by the RC circuit 158, 160 for the energization of the solenoid 132. In the preferred embodiment of the invention, the duration of energization of the solenoid winding is sufficient to assure only that the driving gear 96 engages the gear 80 on the shaft 78 of the turning mechanism for a sufficient time that the two gears come into binding engagement. Thereafter, the mechanics of the driving gear and turning gear assure maintenance of the engagement and hence driving of the latter gear through the over center position of the spring mechanism 88. At that point, the rapid acceleration of the steering gear 80 ejects the driving gear 96 from the engaged position, permitting the spring 100 to return the driving gear to its disengaged position. In an alternative embodiment, if desired, the time duration of the one-shot circuit 128 may be such as to maintain the engagement of the driving gear 96 with the steering mechanism gear 80 for a time duration corresponding to the time required to drive the steering mechanism beyond the over center spring position, at which time the pulse output of the one-shot circuit 128 terminates, the electromagnet 102 is de-energized, and the over center spring mechanism 88 completes the rotation of the steering mechanism shaft through 90° to complete the steering operation. The latter type of system, however, does require more precise control of the pulse output of the one-shot circuit 128, although the mechanical relationship of the driving and the steering gears then is not required since the electromagnet 102 itself assures maintenance of the engagement of these gears for the prescribed time duration, as above described. The reliance on the mechanical configuration to assure maintenance of the engaged position, however, is desirable in that a shorter duration of energization of the solenoid 102 is permitted, with the concomitant reduction in the energy consumed to accomplish the steering operation.

I claim:

1. A toy vehicle and remote control steering system, comprising:

a chassis;

rear wheels, and means mounting said rear wheels to said chassis for rotation;

front wheels, and means mounting said front wheels to said chassis for rotation and turning;

propulsion means mounted within said chassis;

means operatively connecting said rear wheels and said propulsion means to rotate said rear wheels to propel the vehicle along a surface;

means for sensing predetermined sound waves and temporarily connecting said propulsion means to said front wheel mounting means, thereby turning said front wheels to steer said vehicle; and means remote from the vehicle for generating said predetermined sound waves.

2. A toy vehicle and remote control steering system as in claim 1, wherein said means for generating said sound waves is a handheld constant frequency sound wave generator, and said means for sensing and temporarily connecting includes a sonic transducer compatible with said handheld generator.

3. A toy vehicle and remote control steering system as in claim 1, wherein said means mounting said front wheels for turning comprises a movable support, means mounting said support for movement with respect to said chassis between first and second positions, rods to which said front wheels are mounted, said rods having arms mounted to rotate with respect to both said chassis and said support, said front wheels being aligned with said rear wheels when said support is in said first position and turned when said support is in said second position, and means normally urging said support to said first position.

4. A toy vehicle and remote control steering system as in claim 3, wherein said sensing means includes an electromagnet energized only as said sound waves are sensed, and a means responsive to the energization of said electromagnet for moving said support between said first and second positions.

5. A toy vehicle and remote control steering system as in claim 4, wherein said means operatively connecting said rear wheels and said propulsion means comprises a gear train, and wherein said means responsive to the energization of said electromagnet for moving said support comprises a first metal shaft mounted to said chassis for rotation, said first shaft mounted to move between a first position adjacent said electromagnet and a second position spaced therefrom, means for normally biasing said shaft to said second position, a first gear mounted to said first shaft and engaged by said gear train to rotate said shaft, a second gear mounted to said first shaft, a second shaft mounted to said chassis for rotation, a third gear mounted to said second shaft, said second and third gears being engaged to rotate said second shaft when said first shaft is in said first position and disengaged when said first shaft is in said second position, an actuating member mounted to said second shaft, an abutment formed on said support in the path of travel of said actuating member such that as said actuating member engages said abutment said support is moved to said second position.

6. A toy vehicle and remote control steering system as in claim 5, wherein said actuating member comprises an elongated member having opposite end portions that engage said abutment on said support, said elongated member being provided with four rods symmetrically spaced about the juncture of said second shaft and said elongated member, a resilient member attached to said vehicle and positioned to engage an adjacent two of said rods so as to resiliently maintain said elongated member in four distinct positions, two of said positions being where said opposite end portions of said elongated member engage said abutment when said support is in said second position and the remaining two positions being where said support is in said first position.

7. A remote control system for a toy vehicle including an electrically powered drive unit, rear wheels connected to said drive unit, and front wheels mounted for turning, wherein said remote control system comprises:

means for sensing a predetermined sound wave and producing an output signal indicative of said sensed predetermined sound wave;

means for receiving said output signal from said sensing means and connecting said front wheels to said drive unit to thereby turn said front wheels and control steering of said vehicle.

8. A remote control system as in claim 7, further including a means remote from said vehicle for generating said predetermined sound wave.

9. A remote control system as in claim 8, wherein said sound generating means comprises a handheld constant frequency sound wave generator, and said sensing means comprises a sonic transducer.

10. A remote control system as in claim 7, wherein said receiving means comprises an electromagnet and a linkage, whereby said output signal activates said electromagnet creating a magnetic field attracting said linkage, which temporarily connects said drive unit to said front wheels, thereby turning said front wheels and controlling the steering of said vehicle.

11. A remote control system as in claim 10, wherein said sensing means includes a sonic transducer mounted to receive said predetermined sound wave, an amplifier connected to said transducer for providing a first pulse of predetermined wave shape, a one-shot circuit for receiving said first pulse and producing a second pulse of predetermined duration and amplitude, and a power amplifier for amplifying said second pulse to produce said output signal.

* * * * *